US005638789A

United States Patent [19]

Hayner

[11] Patent Number: 5,638,789

[45] Date of Patent: Jun. 17, 1997

[54] METHODS AND SYSTEMS FOR CONTROLLING THE AMOUNT OF FUEL INJECTED IN A FUEL INJECTION SYSTEM

[75] Inventor: David A. Hayner, Arlington Heights, Ill.

[73] Assignee: Motorola, Inc., Schaumburg, Ill.

[21] Appl. No.: 509,554

[22] Filed: Jul. 31, 1995

[51] Int. Cl.[6] ..... F02D 31/00; F02D 41/40

[52] U.S. Cl. ..... 123/357

[58] Field of Search ..... 123/350, 352, 123/357, 358, 365, 500, 501, 502

[56] References Cited

U.S. PATENT DOCUMENTS

| | | | |
|---|---|---|---|
| 4,174,694 | 11/1979 | Wessel et al. | 123/357 |
| 4,223,654 | 9/1980 | Wessel et al. | 123/358 |
| 4,498,016 | 2/1985 | Earleson et al. | 60/39.281 |
| 4,708,111 | 11/1987 | Shiozaki et al. | 123/357 |
| 4,709,335 | 11/1987 | Okamoto | 123/357 |
| 4,730,586 | 3/1988 | Yamaguchi et al. | 123/357 |
| 4,766,863 | 8/1988 | Fujimori | 123/357 |
| 4,914,597 | 4/1990 | Moncelle et al. | 123/352 |
| 4,915,072 | 4/1990 | Caron et al. | 123/357 |
| 5,152,266 | 10/1992 | Sekiguchi et al. | 123/357 |
| 5,339,781 | 8/1994 | Osawa | 123/357 |

*Primary Examiner*—Willis R. Wolfe

*Attorney, Agent, or Firm*—Bruce E. Stuckman; Michael K. Lindsey

[57] ABSTRACT

In a fuel injection system for an internal combustion engine having a positionable valve which controls an amount of injected fuel during a cycle of the internal combustion engine in response to a control signal, a system for controlling the valve position includes an error signal generator for generating an error signal based on the difference between the desired valve position and the actual valve position. A feedback controller generates the control signal based on a fourth derivative, with respect to time, of the error signal.

15 Claims, 4 Drawing Sheets

FIG.4
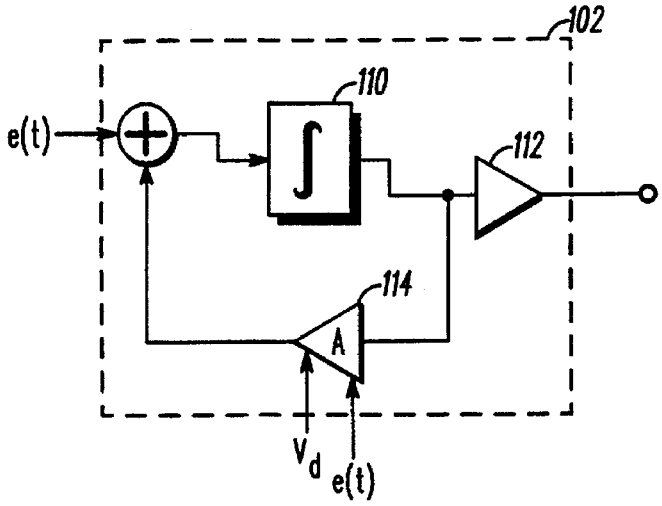
FIG.5
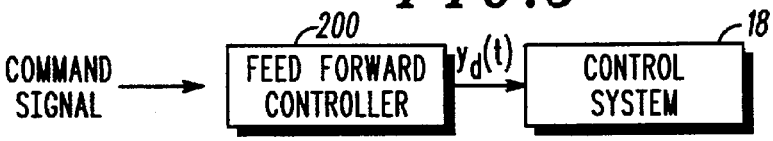
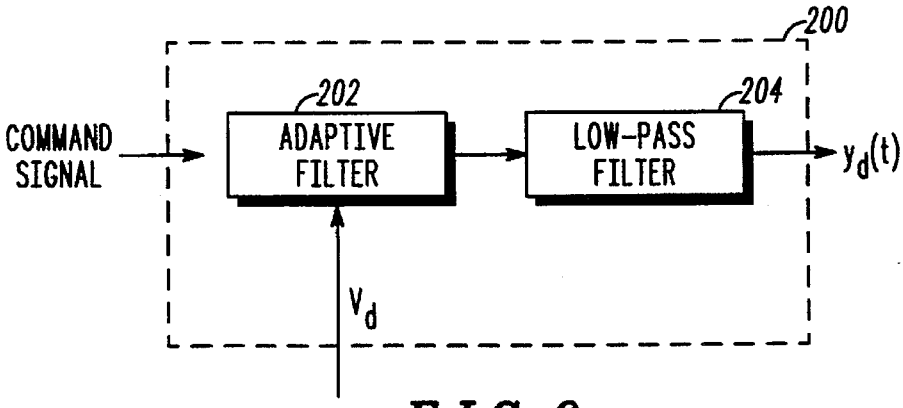
FIG.6

METHODS AND SYSTEMS FOR CONTROLLING THE AMOUNT OF FUEL INJECTED IN A FUEL INJECTION SYSTEM

TECHNICAL FIELD

The present invention relates generally to fuel injection systems for internal combustion engines and, in particular, to methods and systems for controlling the amount of fuel injected.

BACKGROUND OF THE INVENTION

Fuel injection systems are widely used in internal combustion engines. These fuel injection systems allow the amount of fuel introduced into a combustion chamber to be more accurately metered then in non-fuel injected systems.

Fuel injection systems lend themselves to electronic control. By controlling the amount of fuel introduced in the combustion chamber, the overall operation of the engine can be more effectively controlled. Many internal combustion engines use these electronic fuel injection systems in conjunction with electronic engine controllers.

The effectiveness of any electronic fuel injection systems is limited by the response of the fuel injection system to a command to change the amount of fuel introduced into the combustion chamber. U.S. Pat. No. 4,174,694, issued to Wessel et al. provides an automatic control system for controlling the fuel injection mechanism by controlling the fuel control rack of the fuel injection pump. While providing an improvement over the prior art, the system of Wessel et al. can be improved by the incorporation of more advanced control techniques.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

FIG. 4 presents a block diagram representation of a subsystem used in the feedback controller in accordance with one embodiment of the present invention.

FIG. 5 presents a block diagram representation of a controller in accordance with one embodiment of the present invention.

FIG. 6 presents a block diagram representation of a feed-forward controller in accordance with one embodiment of the present invention.

DETAILED DESCRIPTION OF THE PREFERRED EMBODIMENTS

Figure 1:
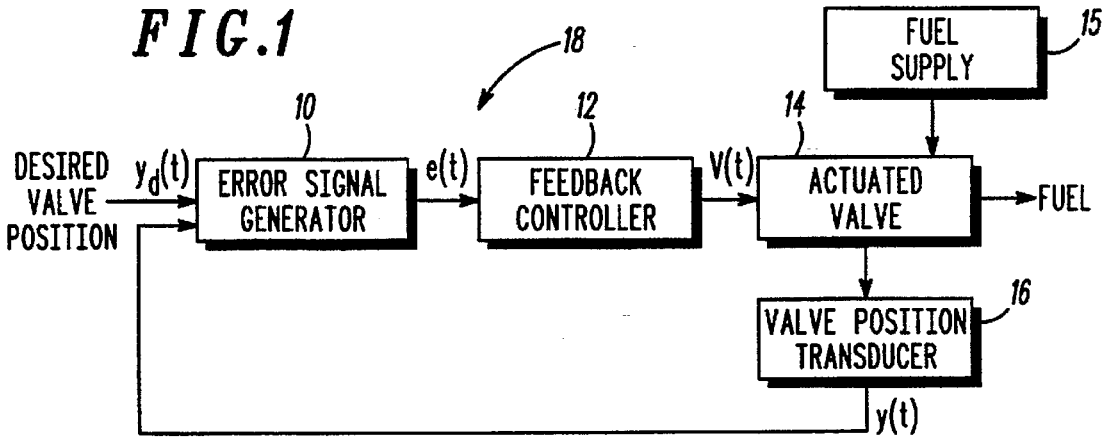
FIG. 1 presents a block diagram representation of the control system in accordance with one embodiment of the present invention.

FIG. 1 presents a block diagram representation of the control system in accordance with one embodiment of the present invention. Control system 18 controls the position of a positionable valve so as to control the amount of fuel injected (such as during a cycle of internal combustion engine). Actuated valve 14 is in fluid communication with fuel supply 15. Actuated valve 14 directly controls the amount of fuel supplied to a combustion chamber by restricting the flow of fuel from the fuel supply 15. The position of actuated valve 14 and thus the amount that the flow of fuel is regulated by actuated valve 14 is controlled by an input signal v(t) that is supplied by feedback controller 12.

Feedback controller 12 implements a control law. The object of the control law is to guarantee that the actuated valve 14 is in the commanded position to ensure that the correct amount of fuel is delivered to the engine. The control law should ensure that when a new command is issued instructing the actuated valve to deliver more or less fuel to the engines, that this is accomplished is a specified maximum amount of time in a known manner to those of ordinary skill in the art. The control law should have the further aim of rejected various disturbances that may cause the valve to deliver too much or too little fuel to the engine, say as a result of variations in the pressure of the fuel delivered to the fuel pump. Feedback controller 12 conditions the controls and compensates for nonlinearities in actuated valve 14 and to enhance the performance of control system 18. The feedback controller 12, described in further detail in conjunction later figures, is in turn responsive to an error signal e(t) generated by an error signal generator 10. Error signal generator 10 generates e(t) by calculating the mathematical difference between the actual valve position y(t) and a desired valve position $y_d(t)$. The actual valve position y(t) is generated by valve position transducer 16 coupled to actuated valve 14 and thus could also be characterized as a "measured valve position" that is representative of the actual valve position.

In a preferred embodiment of the present invention, the internal combustion engine is a Diesel engine. However, one of ordinary skill in the art will recognize that the present invention would also apply to fuel injection for other types of internal combustion engines.

Figure 2:
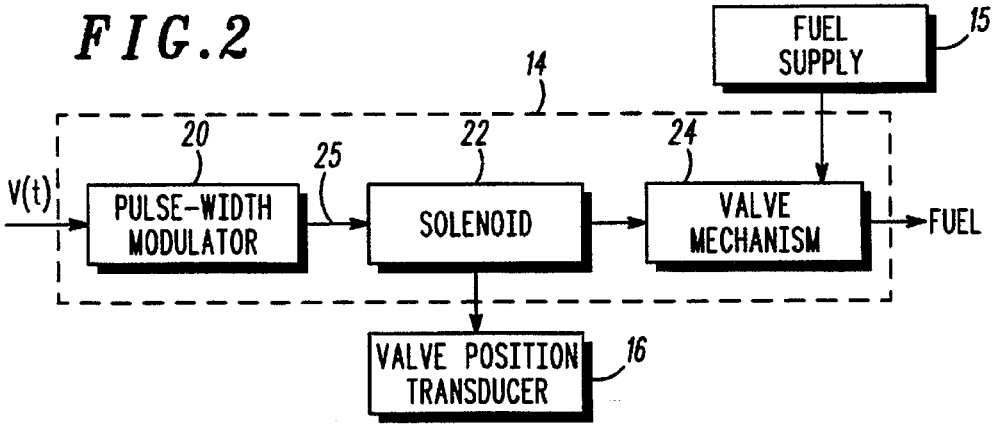
FIG. 2 presents a block diagram representation of the actuated valve of FIG. 1 in accordance with one embodiment of the present invention.

FIG. 2 presents a block diagram representation of the actuated valve of FIG. 1 in accordance with one embodiment of the present invention. Actuated valve 14 comprises pulse width modulator 20, solenoid 22, and valve mechanism 24. These subsystems include the fuel injection mechanism of an internal combustion engine as is know to one of ordinary skill in the art. Valve mechanism 24 provides one or more cams that physically restrict the flow of fuel from fuel supply 15 to the combustion chamber (not shown). The position of the cams of valve mechanism 24 is varied by the position of solenoid 22. In a preferred embodiment, the actual delivery of fuel to the engine is driven by mechanical pumping of the injector pump by the engine.

The solenoid position is in turn controlled by a pulse-width modulated signal 25 generated by pulse-width generator 20 in response to valve position signal v(t). The signal represents either a current or voltage command to the solenoid 22. As a consequence, and appropriate scaling value may be required to correct for the current versus voltage drive cases or a current loop could provide a similar result. The determination of current or voltage drive is a function of design considerations known to those skilled in the art. The duty cycle of a specified frequency square wave is modulated in response to the commanded value v(t). Thus, the root-mean-square (RMS) value of the signal 25 determines the position of solenoid 22. Valve position transducer 16 is a sensor such as a linear variable displacement transformer (LVDT) coupled to the solenoid that generates a signal in proportion to the solenoid position and thus as a function of the position of the valve and the amount of valve restriction.

Figure 3:
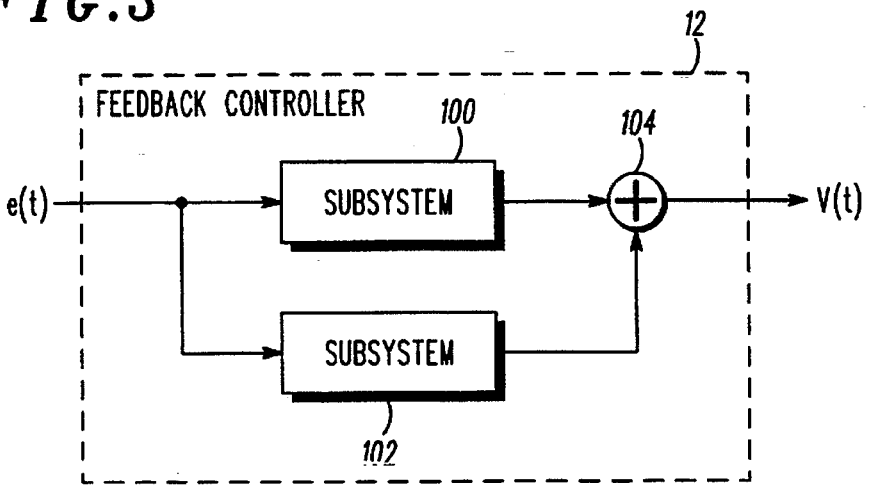
FIG. 3 presents a block diagram of a feedback controller in accordance with one embodiment of the present invention.

FIG. 3 presents a block diagram of a feedback controller in accordance with one embodiment of the present invention. Feedback controller 12 comprises two components, subsystem 100 and subsystem 102. The output of subsystem 100 is combined with the output of subsystem 102 by summer 104 to create the control signal v(t).

In one embodiment of the present invention, subsystem 100 generates the control signal based on a fourth derivative, with respect to time, of the error signal. In a further embodiment of the present invention, subsystem 100 generates first, second and third derivatives, with respect to time, of the error signal and wherein the control signal is generated based on the first, second, and third derivatives, with respect to time, of the error signal. In an additional embodiment of the present invention, subsystem 100 generates first, second, third and fourth derivatives, with respect to time, of the control signal and wherein the control signal is generated based on the first, second, third and fourth derivatives, with respect to time, of the control signal.

In a preferred embodiment of the present invention, subsystem 100 is implemented by a software routine operating on a computer processor such as a microprocessor or a digital signal processor (DSP). In this case the desired derivatives are based on calculated differences. One of ordinary skill in the art will recognize the equivalence between discrete-time and continuous-time embodiments of the present invention. The term "derivative" as used herein should be broadly construed to encompass the differences used in a discrete-time implementation of the present invention. The discrete-time transfer function $H_1(z)$ of subsystem 100, in a preferred embodiment, can be represented by $$H_1(z)=\frac{c_6z+c_7z^2+c_8z^3+c_9z^4}{c_1+c_2z+c_3z^2+c_4z^3+c_5z^4}, \quad (1)$$

where $c_i$ are coefficients of this transfer function. Many possible implementations of this equation will be evident to those of ordinary skill in the art.

FIG. 4 presents a block diagram representation of a subsystem used in the feedback controller in accordance with one embodiment of the present invention. Subsystem 102 includes integrator 110 and amplifier/buffer 112. Integrator 110 calculates the integral of the error signal e(t) that is combined with the output of subsystem 100 by summer 104 to create the control signal v(t). Thus v(t), in one embodiment of the present invention can be described by the following equation:

$$\begin{aligned} v(t) = \; & k_1e(t)+k_2e'(t)+k_3e''(t)+k_4e'''(t)+ \\ & k_5e''''(t)+k_{10}(\mathrm{int}[e(t)])+k_6v'(t)+ \\ & k_7v''(t)+k_8v'''(t)+k_9v''''(t) \end{aligned} \quad (2)$$

wherein v(t) represents the control signal as a function of time, e(t) represents the error signal as a function of time, e'(t) represents a first derivative, with respect to time, of the error signal, e''(t) represents a second derivative, with respect to time, of the error signal, e'''(t) represents a third derivative, with respect to time, of the error signal, e''''(t) represents a fourth derivative, with respect to time, of the error signal, terms $k_i$ each represent control coefficients, v'(t) represents a first derivative, with respect to time, of the control signal, v''(t) represents a second derivative, with respect to time, of the control signal, v'''(t) represents a third derivative, with respect to time, of the control signal, v''''(t) represents a fourth derivative, with respect to time, of the control signal and int[e(t)] represents an integral, with respect to time, of the control signal.

Variable gain amplifier 114 feeds back a portion of integral of the error signal to modify the integral of the error signal. The amount of feedback is modified, in one embodiment of the present invention, based on two quantities e(t) and $V_d$, where $V_d$ represents a damping value derived as a function of the speed of the internal combustion engine in revolutions per minute (RPM).

In a preferred embodiment of the present invention, the damping value is high at low RPM's—corresponding to heavy damping; and the damping value is low at high RPM's—corresponding to lower damping. In a preferred embodiment of the present invention, the gain A of variable gain amplifier 114 is zero, indicating no feedback, unless the value of $V_d$ is low and the error signal e(t) is undergoing a step transition whose magnitude is above a threshold. If however, the value of $V_d$ is low and the error signal e(t) is undergoing a step transition whose magnitude is above a threshold, the gain A is in inverse proportion to the damping value $V_d$.

FIG. 5 presents a block diagram representation of a controller in accordance with one embodiment of the present invention. Feed-forward controller 200 accepts a command signal indicative of desired valve position and generates input signal $Y_d(t)$ to control system 18. Feed-forward controller 200 preconditions the command signal to compensate for nonlinearities in actuated valve 14 and for changes in system operational parameters to enhance the performance of control system 18.

FIG. 6 presents a block diagram representation of a feed-forward controller in accordance with one embodiment of the present invention. Feed-forward controller 200 comprises an adaptive high-pass filter 202 and a low-pass filter 204. In a preferred embodiment of the present invention, feed-forward controller 200 is implemented by a software routine operating on a computer processor such as a microprocessor or a digital signal processor (DSP). The overall discrete-time transfer function $H_2(z)$ of feed-forward controller 200 includes the transfer functions of both the adaptive high-pass filter 202 and a low-pass filter 204. In a preferred embodiment, $H_2(z)$ can be represented by $$H_2(z)=\frac{n_7+n_8z+n_9z^2+n_{10}z^3+n_{11}z^4+n_{12}z^5}{n_1+n_2z+n_3z^2+n_4z^3+n_5z^4+n_6z^5} \quad (3)$$

where $n_i$ are coefficients of this transfer function. Many possible implementations of this equation will be evident to those of ordinary skill in the art. In a preferred embodiment of the present invention, the coefficients of adaptive high-pass filter 202, and thus the coefficients $n_i$ of the transfer function $H_2(z)$ are varied based on the damping value $V_d$. In particular, the frequency shape of the high-pass filter 202 is modified as a function of the damping values. In a preferred embodiment, the high-frequency content is decreased with decreasing values of $V_d$.

Figure 7:
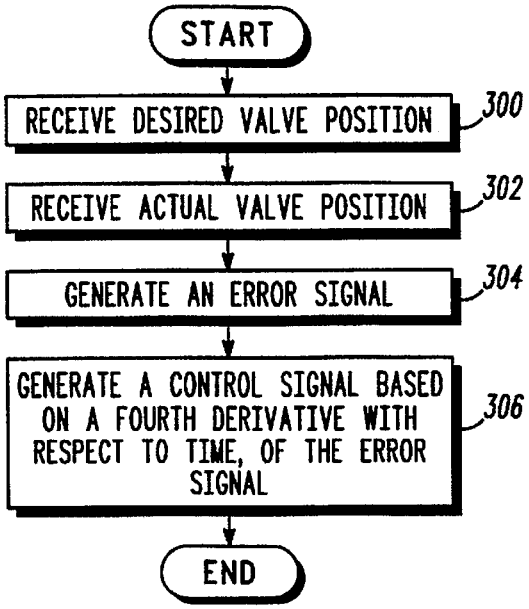
FIG. 7 presents a flowchart representation of a method used in conjunction with the system of FIGS. 1–6 in accordance with one embodiment of the present invention.

FIG. 7 presents a flowchart representation of a method used in conjunction with the system of FIGS. 1–6 in accordance with one embodiment of the present invention. The method begins in step 300 by receiving an input signal representative of a desired valve position and receiving a position signal representative of the actual position of the valve as shown in step 302. An error signal is generated based on the difference between the desired valve position and the actual valve position as shown in step 304. The control signal v(t) is generated based on a fourth derivative, with respect to time, of the error signal.

Figure 8:
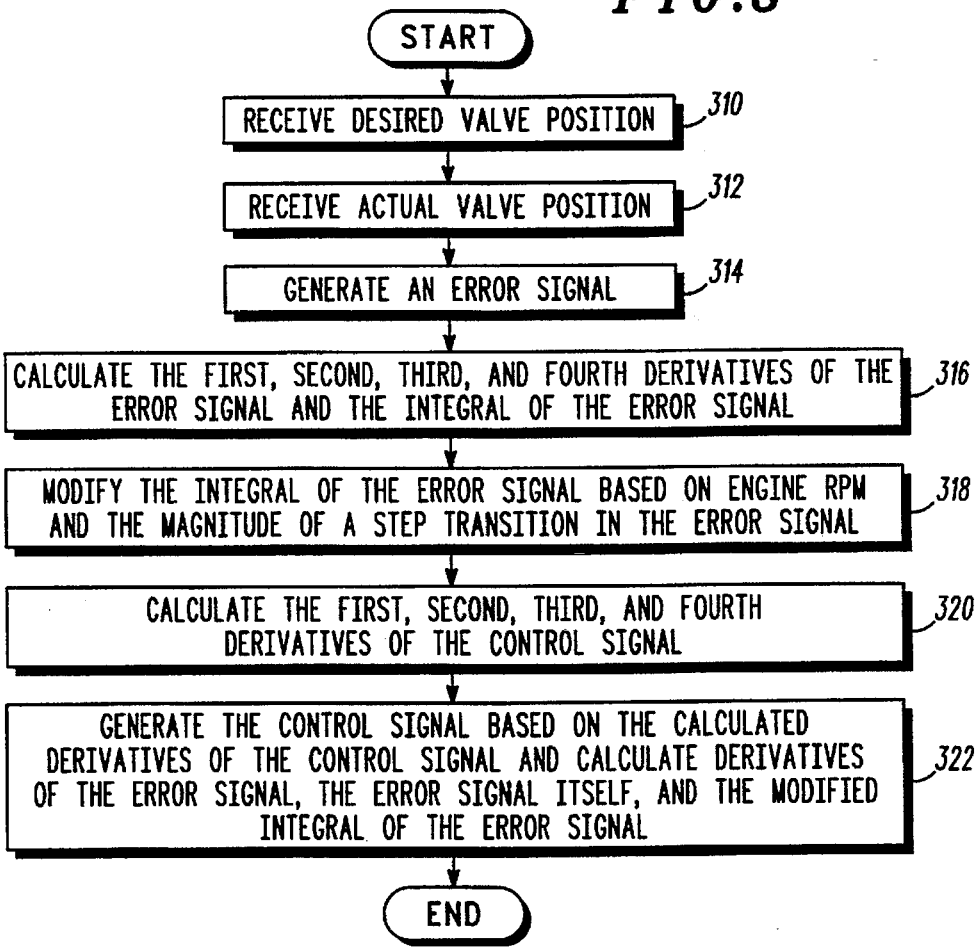
FIG. 8 presents a flowchart representation of a method used in conjunction with the system of FIGS. 1–6 in accordance with one embodiment of the present invention.

FIG. 8 presents a flowchart representation of a method used in conjunction with the system of FIGS. 1–6 in accordance with one embodiment of the present invention. Steps 310–314 correspond to steps 300 to 304 of FIG. 7 respectively. Step 316 includes generating first, second third, and fourth derivatives and the integral, with respect to time, of the error signal. Step 318 includes feeding back a portion of the integral of the error signal, the portion based on the RPM of the internal combustion engine, to modify the integral of the error signal. Step 320 includes generating first, second, third and fourth derivatives, with respect to time, of the control signal. Step 322 includes generating the control signal based on the calculated derivatives of the control signal and the calculated derivatives of the error signal, the error signal itself and the integral of the error signal.

Figure 9:
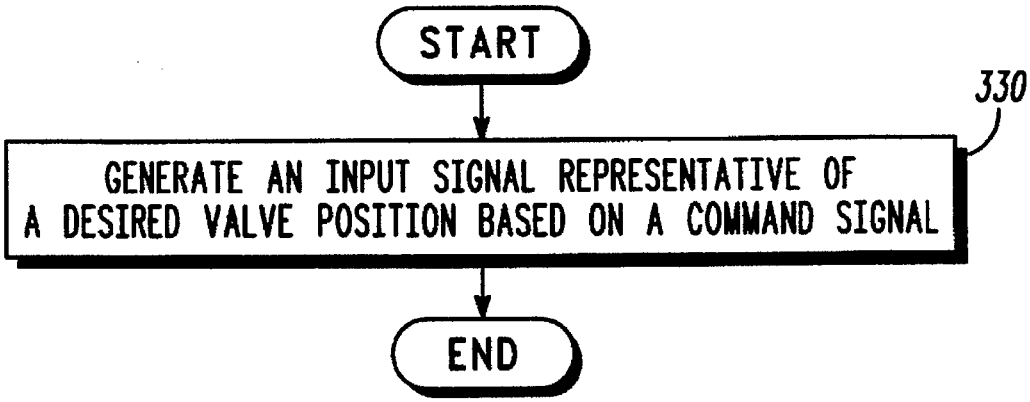
FIG. 9 presents flowchart representation of a method of feed-forward control used in conjunction with the system of FIGS. 1–6 in accordance with one embodiment of the present invention.

FIG. 9 presents flowchart representation of a method of feed-forward control used in conjunction with the system of FIGS. 1–6 in accordance with one embodiment of the present invention. The method includes step 330 of generating the input signal representative of a desired valve position from a command signal using a feed-forward controller.

Figure 10:
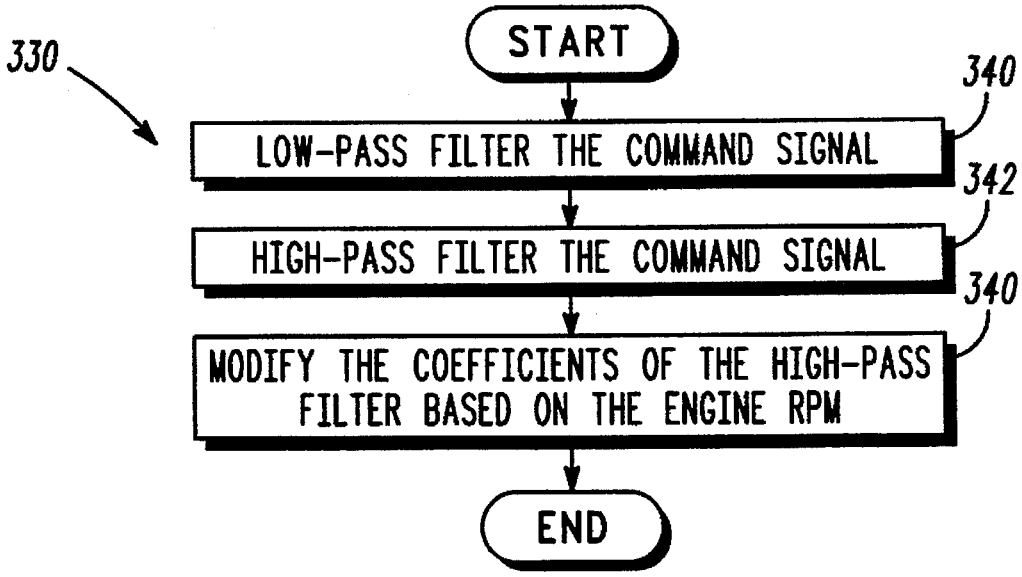
FIG. 10 presents a flowchart representation of a method of feed-forward control used in conjunction with the system of FIGS. 1–6 in accordance with an alternative embodiment of the present invention.

FIG. 10 presents a flowchart representation of a method of feed-forward control used in conjunction with the system of FIGS. 1–6 in accordance with an alternative embodiment of the present invention. Step 340 includes the low-pass filtering the command signal. Step 342 includes high-pass filtering the command signal using a high-pass filter having a plurality of high-pass filter coefficients. Step 344 includes adapting at least one of the plurality of high-pass filter coefficients based upon an operating parameter of the internal combustion engine such as engine RPM. While steps 340–344 are presented in a particular order, other orderings of the steps are possible as will be recognized by one of ordinary skill in the art.

One of ordinary skill in the art will recognize the methods presented herein and many of the system components can be physically realized as a set of computer instructions (software) on a computer or processor, as a hardwired "program" in custom or semi-custom integrated circuits, or in analog electronics.

While specific embodiments of the present invention have been shown and described, it will be apparent to those skilled in the art that the disclosed invention may be modified in numerous ways and may assume many embodiments other than the preferred form specifically set out and described above.

Accordingly, it is intended by the appended claims to cover all modifications of the invention which fall within the true spirit and scope of the invention.

What is claimed is:

1. In a fuel injection system for an Diesel engine having a fuel control rack which controls an amount of injected fuel by a fuel injection pump during a cycle of the Diesel engine, the fuel control rack being positionable by an actuator that is responsive to a control signal, a method for controlling the fuel control rack, the method comprising the steps of:

receiving an input signal representative of a desired fuel injector rack position;

receiving a position signal representative of an actual position of the fuel injector rack from a position transducer;

generating an error signal based on a difference between the desired fuel injector rack position and the actual fuel injector rack position; and generating the control signal whose RMS value is based on a fourth derivative, with respect to time, of the error signal.

2. The method of claim 1 wherein the step of generating further includes the substep of calculating the fourth derivative, with respect to time, of the error signal.

3. The method of claim 1 wherein the step of generating the control signal includes the substep of generating first, second and third derivatives, with respect to time, of the error signal and wherein the control signal is generated based on the first, second, and third derivatives, with respect to time, of the error signal.

4. The method of claim 1 wherein the step of generating the control signal includes the substep of generating first, second, third and fourth derivatives, with respect to time, of the control signal and wherein the control signal is generated based on the first, second, third and fourth derivatives, with respect to time, of the control signal.

5. The method of claim 1 wherein the step of generating the control signal includes the substep of calculating an RMS value for the control signal based upon:

$$v(t) = k_1e(t) + k_2e'(t) + k_3e''(t) + k_4e'''(t) + k_5e''''(t) + k_{10}(\mathrm{int}[e(t)]) + k_6v'(t) + k_7v''(t) + k_8v'''(t) + k_9v''''(t)$$

wherein v(t) represents the control signal as a function of time, e (t) represents the error signal as a function of time, e'(t) represents a first derivative, with respect to time, of the error signal, e"(t) represents a second derivative, with respect to time, of the error signal, e'"(t) represents a third derivative, with respect to time, of the error signal, e""(t) represents a fourth derivative, with respect to time, of the error signal, terms $k_i$ each represent control coefficients, v'(t) represents a first derivative, with respect to time, of the control signal, v"(t) represents a second derivative, with respect to time, of the control signal, v'"(t) represents a third derivative, with respect to time, of the control signal, v""(t) represents a fourth derivative, with respect to time, of the control signal and int[e(t)] represents an integral, with respect to time, of the control signal.

6. The method of claim 1 wherein the step of generating the control signal includes the substep of generating an integral, with respect to time, of the error signal and wherein the control signal is generated based on the integral, with respect to time, of the error signal.

7. The method of claim 6 wherein the step of generating the control signal further includes the substep of feeding back a portion of the integral of the error signal to modify the integral of the error signal.

8. The method of claim 7 wherein the step of generating the control signal further includes the substep of modifying the portion of the integral of the error signal that is fedback as a function of an operating parameters of the Diesel engine.

9. The method of claim 8 wherein the operating parameter is RPM.

10. The method of claim 7 wherein the step of generating the control signal further includes the substep of modifying the portion of the integral of the error signal that is fedback as a function of the error signal.

11. The method of claim 10 wherein the substep of modifying the portion of the integral of the error signal that is fedback as a function of the error signal includes determining a magnitude of a step transition of the error signal over time.

12. The method of claim 1 further comprising the step of generating the input signal representative of a desired valve position from a command signal using a feed-forward controller.

13. The method of claim 12 wherein the step of generating the input signal includes the substep of low-pass filtering the command signal.

14. The method of claim 13 wherein the step of generating the input signal includes the substep of high-pass filtering the command signal using a high-pass filter having a plurality of high-pass filter coefficients.

15. The method of claim 14 further comprising the step of adapting at least one of the plurality of high-pass filter coefficients based upon an operating parameter of the Diesel engine.

* * * * *